United States Patent [19]

Bowling

[11] 4,054,857

[45] Oct. 18, 1977

[54] TIME DELAY DISCONNECT SWITCH

[75] Inventor: Teamus Bowling, Fern Creek, Ky.

[73] Assignee: General Electric Company, Louisville, Ky.

[21] Appl. No.: 710,568

[22] Filed: Aug. 2, 1976

[51] Int. Cl.[2] ..... H01H 61/04

[52] U.S. Cl. ..... 337/129; 337/130

[58] Field of Search ..... 337/72, 128, 129, 130, 337/140, 395, 382, 357, 392, 393

[56] References Cited

U.S. PATENT DOCUMENTS

| | | | |
|---|---|---|---|
| 2,315,960 | 4/1943 | Hottenroth | 200/83 |
| 2,671,840 | 3/1954 | Sway | 200/164 |
| 2,943,172 | 6/1960 | Ingwersen | 337/140 X |
| 3,142,737 | 7/1964 | Brackett | 200/116 |
| 3,176,099 | 3/1965 | Bergsma | 200/113 |
| 3,261,949 | 7/1966 | Roberts | 337/128 |
| 3,514,733 | 5/1970 | Staples | 337/133 |
| 3,864,649 | 2/1975 | Doyle | 335/21 |
| 3,895,263 | 7/1975 | Clark | 361/46 |

*Primary Examiner*—Harry E. Moose, Jr.
*Attorney, Agent, or Firm*—Francis H. Boos

[57] ABSTRACT

An adjustable time delay disconnect switch or hot wire relay for use with a ground fault circuit interrupter in a power circuit to a load, such as an electric range, to provide ground fault protection for any circuit of the range. The switch has normally closed switch contacts, a biased actuator plunger for opening the contacts, a biased latch for disabling the plunger, and an adjustable hot wire for releasing the latch and hence the plunger when the circuit is overloaded. The plunger is manually resettable when the circuit condition returns to normal.

8 Claims, 5 Drawing Figures

TIME DELAY DISCONNECT SWITCH

BACKGROUND OF THE INVENTION

1. Field Of The Invention

This invention relates to circuit breakers and hot wire relays for use in protecting a circuit from high leakage current or short circuits.

2. Description Of The Prior Art

The present invention relates to a time delay disconnect switch or hot wire relay as one component of a ground fault circuit interrupter for use with an appliance such as an electric range for the purpose of preventing high current leakage hazards or short circuits. Such ground fault circuit interrupters (GFCI) are required by the Underwriters Laboratory, Inc. for use with bathrooms, outdoor residential receptacles, swimming pools, and construction sites. An example of such a ground fault circuit interrupter system is taught in the Clark Pat. No. 3,895,263. Such a system employs a differential current transformer for detecting a leakage current path by measuring the difference in current entering the load and in the current leaving the load, and if the signal from the sensor exceeds the level detector threshold, it is amplified and timed. If the signal is above the threshold long enough to time out the timer, a driver will supply power to the disconnect switch which will interrupt power to the load. This particular patent does not describe in detail the particular disconnect switch that it employs.

The present invention employs a disconnect switch in the form of a hot wire relay of a special design to obtain time delay. An example of a simple hot wire relay is shown in the Bergsma Pat. No. 3,176,099 which uses an in-circuit self-heating resistance wire referred to as a "hot" wire or "sag" wire such that when the magnitude of the input circuit current exceeds a certain limit, the hot wire will elongate sufficiently for making or breaking the output circuit-controlling electrical contact.

Another example of a snap-action hot wire power-switching relay is described in the Staples U.S. Pat. No. 3,514,733, which is assigned to the assignee of the present invention. One of the main differences between the present invention and the Staples relay is the construction to provide time delay in the present disconnect switch to avoid spurious operation and destructive arcing and premature failure.

The Doyle U.S. Pat. No. 3,864,649 shows a ground fault circuit interrupter and its disconnect switch combined in a single wiring device, while in the present invention the disconnect switch is separate from the sensing and firing circuit.

The Brackett U.S. Pat. No. 3,142,737 shows a hot wire relay or circuit breaker having a positive connection between the movable contact blade and the manula reset plunger. This patented design is much more complex and expensive than the present invention. The value of this patented design can only be judged fairly by its operation under actual test conditions, but its complexity over the present invention would lead one skilled in this art to doubt its acceptability.

The present disconnect switch employs wiping contact action which serves to maintain the contact surfaces clean, but this is not generally new per se, as it is taught in the Sway U.S. Pat. No. 2,671,840 and the Hottenroth U.S. Pat. No. 2,315,960, both of which are assigned to the present assignee. It is felt that the present invention relates to the overall design of an adjustable time delay disconnect switch and the novel method of obtaining the wiping action of the contacts and avoiding destructive arcs during contact opening.

The principal object of the present invention is to provide an adjustable time delay disconnect switch for use in a ground fault circuit interrupter system with a time delay that can be varied between 15 milli-seconds and 500 milli-seconds, depending upon the circuit conditions to be governed.

A further object of the present invention is to provide a GFCI with a disconnect switch having switch contacts with a controlled contact gap in less than a half cycle so as to restrict the amount of arc struck during contact separation.

SUMMARY OF THE INVENTION

The present invention, in accordance with one form thereof, relates to a time delay disconnect switch using thermal-responsive means for controlling a biased latch means which in turn controls a biased actuator means for opening normally closed switch contacts so that a predetermined current flow in a conductor causes the thermalresponsive means to release the latch means from engagement of the actuator means, thereby allowing the biased actuator means to force the movable contact means open. The actuator means is manually resettable with respect to the latch means when current flow in the conductor and hence the thermal-responsive means has returned to its normal condition.

BRIEF DESCRIPTION OF THE DRAWINGS

This invention will be better understood from the following description taken in conjunction with the accompnaying drawings and its scope will be pointed out in the appended claims.

DESCRIPTION OF THE PREFERRED EMBODIMENT

Figure 1:
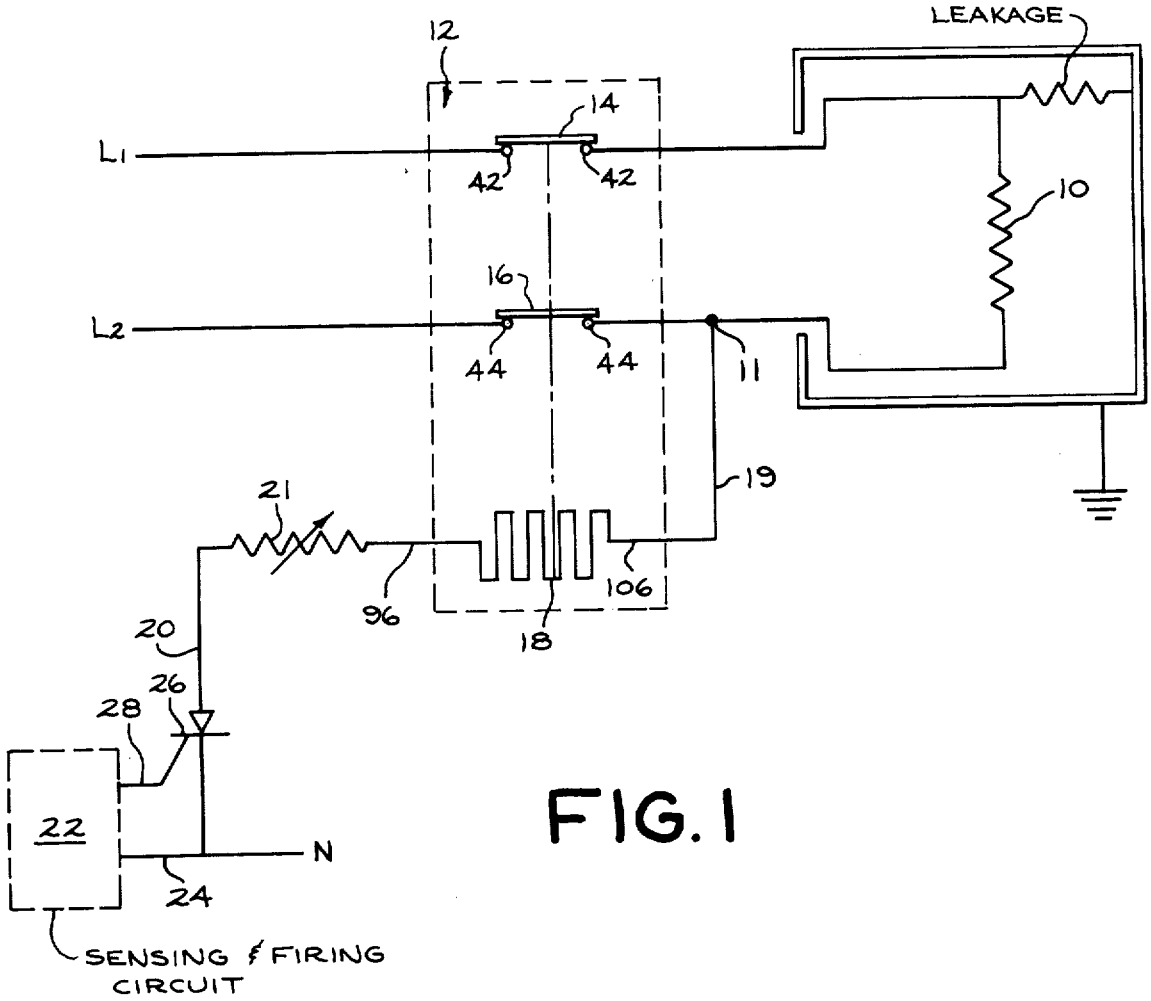
FIG. 1 is a circuit diagram of a ground fault circuit interrupter that includes a double pole, single throw, time delay disconnect switch of the present invention connected in circuit with the power leads of a load, such as an electric range.

Turning now to a consideration of the drawings, and in particular to FIG. 1, there is shown a power circuit for a load 10. The load for the circuit is indicated as an electric range load having a 238 volt AC power line indicated as lines $L_1$ and $L_2$. Connected in both lead wires $L_1$ and $L_2$ is the time delay disconnect switch or hot wire relay 12 of the present invention having movable switch contacts 14 and 16 for controlling both sides of the line. There is an in-circuit hot wire 18 that is joined by lead 19 to line $L_2$ at a point 11 between the load 10 and the switch contacts. The other side of the hot wire 18 is connected by lead 20 through a dropping resistor 21 and SCR 23 to a neutral or ground wire N. A solid state sensing and firing circuit 22 is joined to the neutral conductor N by lead 24 and to the gate 26 of the SCR by means of lead 28. The sensing and firing circuit 22 detects the presence of current leakage in the range load 10 by detecting the difference in current entering the range load 10 and the current leaving the range load, that is the differential current in lines $L_1$ and $L_2$. The difference in the two current flows leaks from a faulty electrical component to the range cabinet that is grounded. Thus, this condition is described as a ground fault. If the signal from the sensing circuit exceeds the level detector's threshold, the signal is amplified and timed. If the signal is above the threshold long enough to time out the timer, power will flow to the hot wire 18 causing it to become heated and elongated to relieve the pressure on the latch member and unlatch the actuator plunger, thus opening the switch contacts and interrupting the power to the range load 10. The sensing and firing circuit 22 may employ a ring coil (not shown) which operates much the same as the sensor of a familiar clamp-on ammeter except that it encircles both lead wires $L_1$ to $L_2$ to detect a difference in current.

Figure 2:
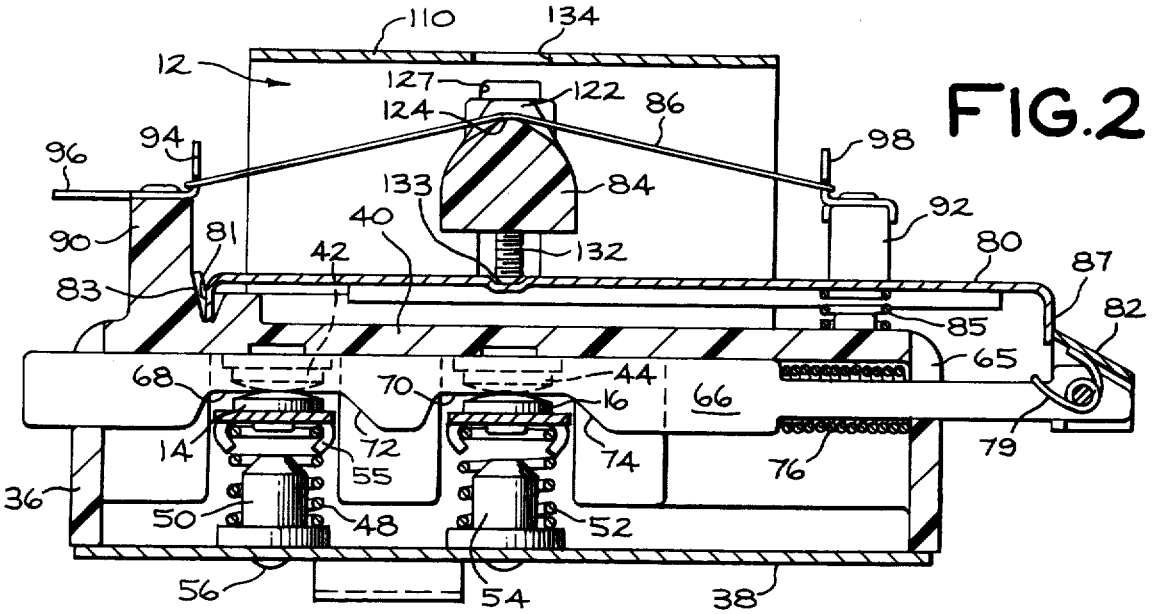
FIG. 2 is a cross-sectional elevational view of a disconnect switch of the present invention showing the switch contacts in the normally closed position with a hot wire shown in tension at the top of the switch, and furnished with an armature that bears down onto a pivoted, spring-biased latch member that in turn disables a spring-biased actuator plunger that, when released, will cause the movable contacts to open the circuit as well as de-energize the hot wire.

Now turning to a consideration of FIG. 2, the disconnect switch 12 comprises a hollow insulating housing 36 that is open at the bottom and adapted to be closed by a flat metal cover plate 38, which also serves as its mounting strap. Fixed to the underside of the top wall 40 of the housing 36 are two pairs of fixed contacts 42 and 44. A movable contact bar 14 cooperates with the first pair of fixed contacts 42, and movable contact bar 16 cooperates with the second pair of fixed contacts 44. Each contact bar 14 and 16 is a bridging contact member which is spring-biased into a normally closed position with the mating fixed contacts, as seen in FIG. 2. Contact bar 14 is seated on a central compression spring 48 that is in turn seated on an insulating post 50 that is attached to the cover plate 38 by a fastener 56. Similarly, the contact bar 16 is provided with a compression spring 52 that is seated on an insulating post 54. Side tabs 55 of the contact bars are crimped onto the springs 48 to prevent separation.

Figure 3:
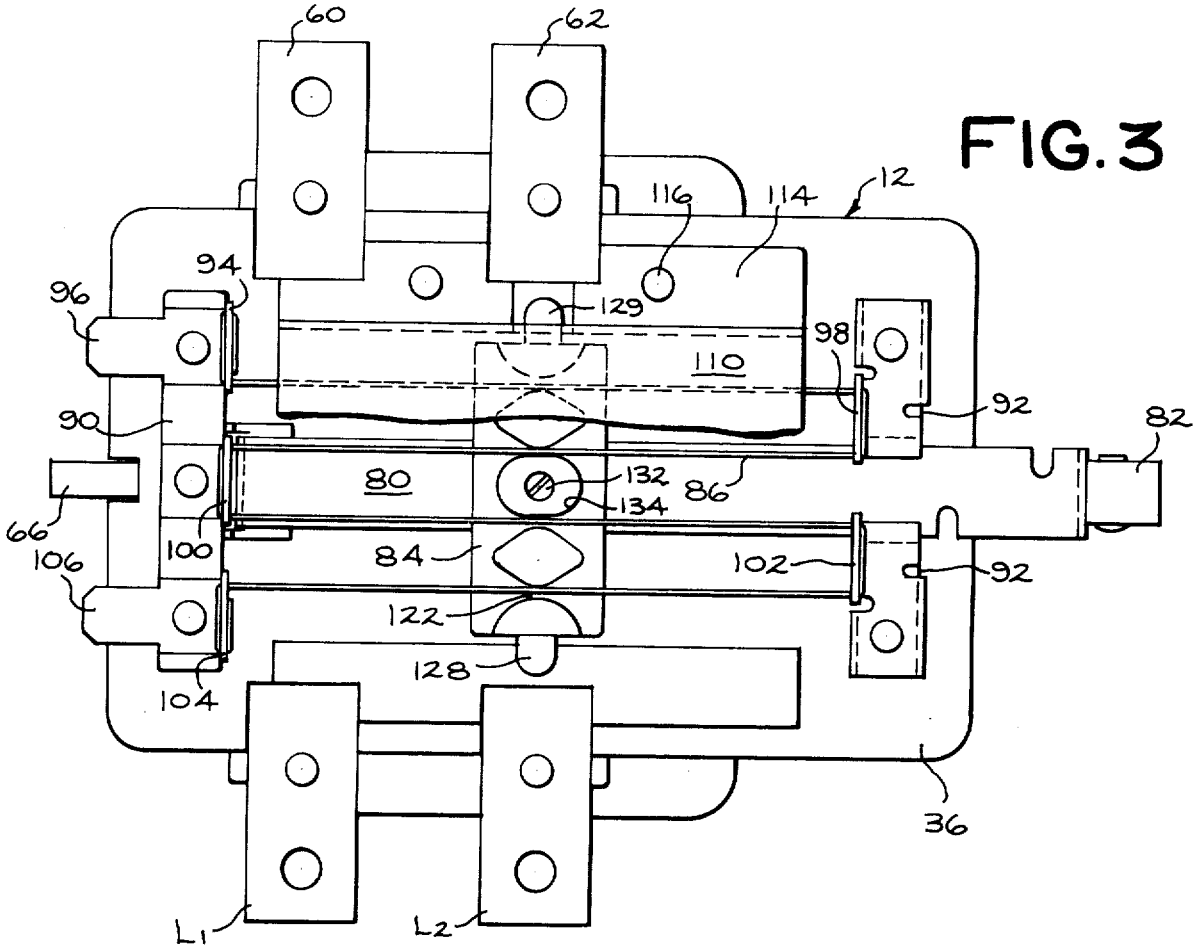
FIG. 3 is a top plan view of the disconnect switch of FIG. 2 with a part of the top cover plate removed to expose to view the elongated hot wire wound in a sinuous shape, as well as show the various electrical terminals of the disconnect switch.

FIG. 3 is a plan view of the switch of FIG. 2, and the two line terminals of the switch are identified as $L_1$ and $L_2$ for fixed contacts 42 and 44, respectively, and the load terminals are identified as 60 and 62. Thus, the pair of fixed contacts 42 are provided with opposite terminals $L_1$ and 60, respectively, while the pair of fixed contacts 44 are provided with opposite terminals $L_2$ and 62.

The disconnect switch housing 36 is provided with an actuator plunger 66 of insulating material which is elongated so that it extends completely through the housing and out suitable openings 63 and 65 in the opposite end walls of the housing, and is supported within the openings so that it is capable of moving back and forth a limited amount within the housing. The actuator plunger 66 is a beam-like member that has a pair of recesses 68 and 70 in its lower edge so that when these recesses 68 and 70 overlie the contact bars 14 and 16, respectively, the plunger is out of contact with the contact bars so that the biasing springs 48 and 52 are free to hold the movable contact bars close against the pairs of fixed contacts 42 and 44.

Figure 4:
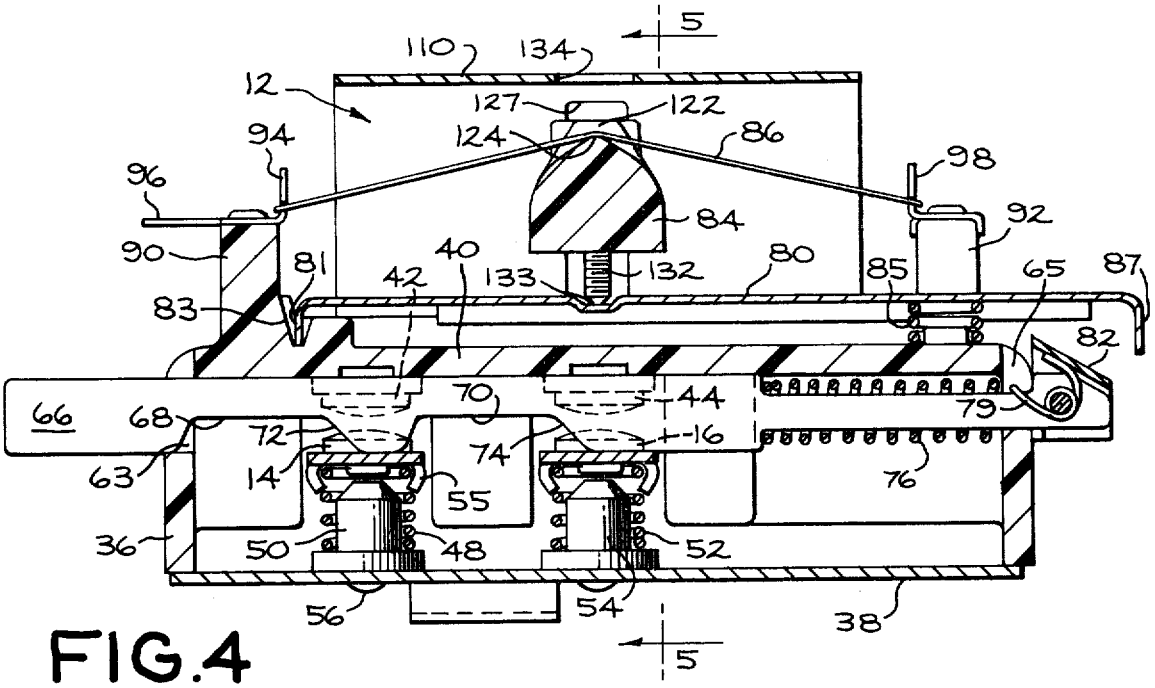
FIG. 4 is a cross-sectional elevational view similar to that of FIG. 2 but is shown after the hot wire has been energized and expanded to allow the latch member to pivot upwardly and release the actuator plunger, causing the plunger to move to the left and cam the movable contact bars open and hold them open until the actuator plunger is manually reset.

Each recess 68 and 70 is provided with an inclined ramp or cam surface 72 and 74, respectively, which is adapted to bear against the side of the related contact bars 14 and 16, respectively, for causing the contact bars to tilt or rock on their supporting springs 48 and 52 when an inclined force is exerted by the ramp on the side of the bar when the plunger is shifted to the left. Thus, when the actuator plunger 66 moves to the left a sufficient amount, the contact bars 14 and 16 are forced out of the recesses 68 and 70, as is shown in FIG. 4. Then, the contact bars are held open by the lower edge of the plunger. this is clearly shown in the cross-sectional side view of FIG. 5. A biasing spring 76 is fitted onto the plunger and bears against the adjacent end wall of the housing 36 to normally urge the plunger to the left to open the switch contacts. Notice in FIG. 5 that the contact faces of the contact bar 16 are convex. It is important that at least these contact faces are convex for making a clean wiping action between the switch contacts during the opening and closing of the switch contacts. The wiping action is caused by the rolling or tilting of the contact bars 14 and 16 when the ramps 72 and 74 are pressing against the side of the contact bars.

Since this disconnect switch 12 is provided with normally closed switch contacts, as is shown in FIG. 2, some means must be provided for disabling the actuator plunger 66. This disabling means is in the form of a biased latch member 80 which cooperates with a hinged pawl 82 that is pivoted on the right end of the plunger 66. A small torsion spring 79 is assembled with the pawl to urge it clockwise.

This latch member 80 is a thin metal strip that is pivotally supported at its left end by folding down a tab 81 that is then positioned in a tapered groove 83. The opposite end of the latch member 80 is supported on a compression spring 85, and the free end of the latch member has a downturned finger 87 which is adapted to cooperate with the hinged pawl 82 of the plunger 66. The latch member 80 is held in locking engagement with the pawl 82 of the plunger 66 by means of an insulating armature 84 in combination with a hot wire 86. The top surface of the insulating switch housing 36 is provided at its opposite ends with a wall portion 90 at one end and a pair of posts 92 at the opposite end. The top of the wall 90 is fitted with three spaced matal tabs 94, 100 and 104. Tab 94 has a terminal 96 and tab 104 has a terminal 106. At the opposite end, one post 92 has a tab 98 and the other post 92 has a tab 102. As is best seen in FIG. 3, the hot wire 86 is a single elongated strand of resistance heater wire of Nichrome or the like that is fastened at one end to the metal tab 94. Then the wire 86 extends from this tab 94 to the opposite end of the switch housing and twisted around tab 98 and then extended over to third tab 100, and then extends to the opposite end and around tab 102 and finally to the opposite end where it is fastened to tab 104.

Figure 5:
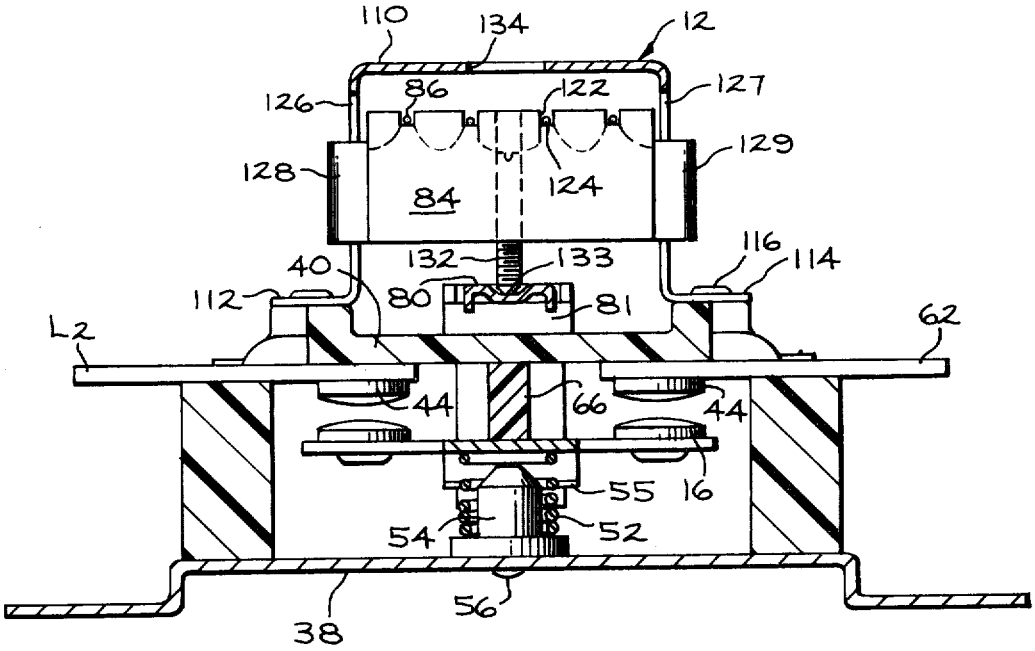
FIG. 5 is a cross-sectional elevational view taken on the line 5—5 of FIG. 4 showing the actuator plunger holding one of the contact bars open, as well as showing the cooperation between the hot wire and the armature and the latch member.

An insulating armature 84 of porcelain or the like is arranged beneath the hot wire 86 adjacent the center of the switch housing. The armature 84 is provided with a vertical calibrating screw 132 that is seated in a dimple 133 in the latch member 80. The screw has a head recessed in the top of the armature and is provided with a screwdriver slot (not shown) for receiving a screwdriver to tighten the armature between the wire 86 and the latch member 80. Thus, the tension of the wire 86 that is adjusted by the calibration screw 132 varies the amount of the downward force against the upward force of the spring 85. This adjustment also determines the amount of vertical overlap between the latch finger 87 and the hinged pawl 82 of the actuator plunger. The overlap is a factor in the amount of time delay between the time of energization of the hot wire 86 by the sensing and firing circuit 22 and the opening of the switch contacts 14 and 42, and 16 and 44. A second factor in the amount of time delay is the size of the spring 76 of the actuator. The top surface of the armature 84 is provided with a series of four grooves 122, each for receiving one strand or pass of the wire 86. Each groove 122 has a transverse knife edge 124 at the bottom, as is best seen in FIG. 4, so there is generally point contact between the hot wire 86 and the armature 84 within the groove 122. A folded sheet metal cover 110 is positioned over the hot wire 86 and the armature 84, as is clear from FIGS. 4 and 5. The cover plate is of generally channel formation having lower supporting flanges 112 and 114 which are fastened to the top of the switch housing 36 by fasteners 116. The main purpose of the cover is to serve as vertical guide means for movement of the armature 84. Vertical slots 126 and 127 are formed in the opposite side walls of the cover 110 as is best seen in FIG. 5. The armature 84 is fitted with wings 128 and 129 which are keyed into the slots 126 and 127, respectively, so the motion of the armature is limited to vertical motion. An access opening 134 is formed in the top of the cover plate 110 over the screw 132 for insertion of a screwdriver for adjusting the tension on the wire 86.

When the hot wire 86 is not energized, it has a certain finite length. When the hot wire 86 is energized, it is self-heating which causes the wire to elongate and allows the armature to rise to relieve the pressure on the latch member 80. Looking at FIG. 2, as the latch member pivots upwardly about its tab 81, the finger 87 moves to release the pawl 82. As the finger separates from the pawl, the spring 76 is free to shift the plunger 66 to separate the contact bars 14 and 16 from the fixed contacts 42 and 44 respectively.

Having described above a novel adjustable time delay disconnect switch, it should be understood by those skilled in this art that the low thermal mass hot wire 86 responds nearly instantaneously to the power input ($E^2/R$) such that a series of relaxation steps occur at each peak of the applied voltage. The final relaxation step tends to release the latch finger 87 from the pawl 82 of the plunger 66 at or near the peak of the applied voltage. The mass of the plunger 66 and the spring constant of spring 76 are chosen such that the switch contact opening is substantially synchronous with the zero current crossing so as to minimize arcing.

Modifications of this invention will occur to those skilled in this art; therefore, it is to be understood that this invention is not limited to the particular embodiments disclosed, but that it is intended to cover all modifications which are within the true spirit and scope of this invention as claimed.

What is claimed is:

1. A time delay disconnect switch for controlling the flow of current in a conductor and interrupting the flow in the event of a predetermined current, said switch comprising a housing with fixed and movable contact means for making and breaking a circuit with the conductor, biasing means for holding the movable contact means normally closed with the fixed contact means, biased actuator means for forcing the movable contact means away from the fixed contact means at a relatively slow rate, and a biased latch means for disabling the actuator means, an adjustable thermal-responsive means acting upon the said latch means for holding the latch means in engagement with the said actuator means, whereby a predetermined current flow in the conductor causes the thermal-responsive means to release the latch means for engagement with the actuator means thereby allowing the biased actuator means to force the movable contact means away from the fixed contact means with a controlled contact gap in less than a half cycle, said actuator means being manually resettable with respect to the latch means when the said thermal-responsive means has returned to its normal condition.

2. The invention of claim 1 wherein the said adjustable thermal-responsive means includes an elongated heat-expansible, electrically-conductive wire held in tension by an insulating armature, said armature including an adjustable calibration means that bears upon the said latch means for adjusting the time delay between about 15 milliseconds and about 500 milliseconds.

3. The invention of claim 2 wherein the said adjustble thermal-responsive means includes a low thermal mass hot wire that responds nearly instantaneously to the power input such that a series of relaxation steps of the wire occur at each peak of the applied voltage until the final step releases the latch means from the actuator means, the mass of the plunger and the size of the biasing means of the actuator means being chosen such that the switch contact means has a controlled minimum contact gap in leass than one half a cycle and the contact opening is substantially synchronous with the zero current crossing so as to minimize arcing.

4. The invention of claim 1 wherein the said actuator means is a spring-biased plunger having camming means engageable with the movable contact means which cause the movable contact means to roll with a wiping action on the fixed contact means when the actuator means is moved relative to the movable contact means.

5. The invention of claim 2 wherein the said disconnect switch contacts control both sides of the line of a power circuit, there being two pairs of fixed contacts and a movable bridging bar serving each pair of fixed contacts, said actuator plunger cooperating with both said bridging bars to operate them simultaneously.

6. The invention of claim 4 wherein the said adjustable thermal-responsive means includes an elongated heat-expansible, electrically-conductive wire held in tension by an insulating armature, said armature including an adjustable calibration means that bears upon the said latch means, said latch means having one end portion pivotally supported from the housing, spring means supporting the opposite end portion of the latch means, the latch means including a locking finger adjacent its free end, the said spring-biased actuator plunger including a pawl adjacent one end for cooperation with the locking finger of the said latch means.

7. The invention of claim 6 wherein at least the said movable contacts have convex contact faces for improving the wiping action of the contacts during opening, the camming means of the springbiased actuator plunger represented by inclined ramps that act upon the sides of the movable bridging bars to rock the bars during both the opening and the closing of the switch contacts.

8. The invention of claim 7 wherein the said springbiased plunger has a compression spring of such size as to slow the rate of contact opening within one half a cycle, thereby controlling the amount of the arc when the contacts separate, the disconnect switch being adapted to be connected to a source of alternating current so as to extinguish the arc by opening the contacts at or near zero current crossing and de-energize the circuit and shut itself off for its own self-protection to avoid runaway conditions.

* * * * *